United States Patent [19]

de la Burde et al.

[11] 4,258,729

[45] Mar. 31, 1981

[54] NOVEL TOBACCO PRODUCT AND IMPROVED PROCESS FOR THE EXPANSION OF TOBACCO

[75] Inventors: Roger Z. de la Burde, Powhatan; Patrick E. Aument, Hopewell; Francis V. Utsch, Chester, all of Va.

[73] Assignee: Philip Morris Incorporated, New York, N.Y.

[21] Appl. No.: 891,468

[22] Filed: Mar. 29, 1978

[51] Int. Cl.[3] ..... A24B 3/18

[52] U.S. Cl. ..... 131/140 P

[58] Field of Search ..... 131/2, 140 P

*Primary Examiner*—V. Millin

*Attorney, Agent, or Firm*—Watson, Leavenworth, Kelton & Taggart

[57] ABSTRACT

A novel tobacco product comprising tobacco containing gaseous carbon dioxide in an amount of at least 1 part of gaseous carbon dioxide per 100 parts of tobacco. The product, when rapidly heated is converted to expanded tobacco. An improved process for the expansion of tobacco is also provided which employs carbon dioxide as the expansion agent in a sequence of steps comprising: (1) contacting tobacco with carbon dioxide gas at a pressure of at least 250 psig for a time sufficient to impregnate the tobacco with the carbon dioxide gas, (2) releasing the pressure and (3) thereafter subjecting the carbon dioxide-treated tobacco to rapid heating conditions to remove the carbon dioxide and thereby expand the tobacco.

5 Claims, No Drawings

EQUILIBRIUM CURVE FOR CARBON DIOXIDE

*Pressure-enthalpy diagram for carbon dioxide.*

NOVEL TOBACCO PRODUCT AND IMPROVED PROCESS FOR THE EXPANSION OF TOBACCO

BACKGROUND OF THE INVENTION

Various processes have been proposed for expanding tobacco. For example, tobacco has been contacted with a gas under somewhat greater than atmospheric pressure, followed by a release of the pressure, whereby the tobacco cells are expanded to increase the volume of the treated tobacco. Other methods which have been employed or suggested have included the treatment of tobacco with various liquids, such as water or relatively volatile organic liquids, to impregnate the tobacco with the same, after which the liquids are driven off to expand the tobacco. Additional methods which have been suggested have included the treatment of tobacco with solid materials which, when heated, decompose to produce gases which serve to expand the tobacco. Other methods include the treatment of tobacco with gas-containing liquids, such as carbon dioxide-containing water, under pressure to incorporate the gas in the tobacco and when the tobacco impregnated therewith is heated or the pressure thereon is reduced to thereby expand the tobacco. Additional techniques have been developed for expanding tobacco which involve the treatment of tobacco with gases which react to form solid chemical reaction products within the tobacco, which solid reaction products may then decompose by heat to produce gases within the tobacco which cause expansion of the tobacco upon their release. More specifically:

A patent to Wilford J. Hawkins, U.S. Pat. No. 1,789,435, granted in 1931, describes a method and apparatus for expanding the volume of tobacco in order to make up the loss of weight caused in curing tobacco leaf. To accomplish this object, the cured and conditioned tobacco is contacted with a gas, which may be air, carbon dioxide or steam under about 20 pounds of pressure and the pressure is then relieved, whereby the tobacco tends to expand. The patent states that the volume of the tobacco may, by that process, be increased to the extent of about 5–15%.

An alien property custodian document No. 304,214 to Joachim Bohme, dated 1943, indicates that tobacco can be expanded using a high-frequency generator but that there are limitations to the degree of expansion which can be achieved without affecting the quality of the tobacco.

A patent to Frank J. Sowa, U.S. Pat. No. 2,596,183, granted in 1952, sets forth a method for increasing the volume of shredded tobacco by adding additional water to the tobacco to cause the tobacco to swell and thereafter heating the moisture containing tobacco, whereby the moisture evaporates and the resulting moisture vapor causes expansion of the tobacco.

A series of patents to Roger Z. de la Burde, U.S. Pat. Nos. 3,409,022, 3,409,023, 3,409,027 and 3,409,028, granted in 1968, relate to various processes for enhancing the utility of tobacco stems for use in smoking products by subjecting the stems to expansion operations utilizing various types of heat treatment or microwave energy.

A patent to John D. Hind, U.S. Pat. No. 3,425,425, granted in 1969, which is assigned to the same assignee as the assignee of the present invention, relates to the use of carbohydrates to improve the puffing of tobacco stems. In that process, tobacco stems are soaked in an aqueous solution of carbohydrates and then heated to puff the stems. The carbohydrate solution may also contain organic acids and/or certain salts which are used to improve the flavor and smoking qualities of the stems.

A publication in the "Tobacco Reporter" of November 1969 by P. S. Meyer describes and summarizes tobacco puffing or expansion procedures or investigations for expanding and manipulating tobacco for purposes of reducing costs and also as the means for reducing the "tar" content by reduction in the delivery of smoke. Mention is made in this publication of puffing tobacco by different procedures including the use of halogenated hydrocarbons, low pressure or vacuum operation, or high pressure steam treatment that causes leaf expansion from inside the cell when outside pressure is suddenly released. Mention is also made in this publication of freeze-drying tobacco which can also be employed to obtain an increase in volume.

Since the above-mentioned "Tobacco Reporter" article was published, a number of tobacco expansion techniques, including some of the techniques described in the article, have been described in patents and/or published patent applications. For example, U.S. Pat. No. 3,524,452 to Glenn P. Moser et al and U.S. Pat. No. 3,524,451 to James D. Frederickson, both issued in 1970, relate to the expansion of tobacco using a volatile organic liquid, such as a halogenated hydrocarbon.

U.S. Pat. No. 3,734,104 to William M. Buchanan et al, which is assigned to the same assignee as the assignee of the present invention, issued in 1973, relates to a particular process for the expansion of tobacco stems.

U.S. Pat. No. 3,710,802 to William H. Johnson, issued in 1973 and British Specification No. 1,293,735 to American Brands, Inc., published in 1972, both relate to freeze-drying methods for expanding tobacco.

South African applications 70/8291 and 70/8282 to R. J. Reynolds Tobacco Company, both filed in 1970, relate to tobacco expansion employing chemical compounds which decompose to form a gas or with inert solutions of a gas under pressure to maintain the gas in solution until it impregnates the tobacco.

A patent to Robert G. Armstrong, U.S. Pat. No. 3,771,533, issued in 1973, which is assigned to the same assignee as the assignee of the present invention, involves a treatment of tobacco with carbon dioxide and ammonia gases, whereby the tobacco is saturated with these gases and ammonium carbonate is formed in situ. The ammonium carbonate is thereafter decomposed by heat to release the gases within the tobacco cells and to cause expansion of the tobacco.

Despite all of the above-described advances in the art, no completely satisfactory process has been found. The difficulty with the various earlier suggestions for expanding tobacco is that, in many cases, the volume is only slightly or at best only moderately increased. For example, freeze-drying operations have the disadvantages of requiring elaborate and expensive equipment and very substantial operating costs. With respect to the teaching of using heat energy, infrared or radiant microwave energy to expand tobacco stems, the difficulty is that while stems respond to these heating procedures, tobacco leaf has not generally been found to respond effectively to this type of process.

The use of special expanding agents, for example, halogenated hydrocarbons, such as are mentioned in the Meyer publication for expanding tobacco, is also not completely satisfactory, because some of the materials employed are not always desired as additives. Furthermore, the introduction, in considerable concentration, of materials which are foreign to tobacco presents the problem of removing the expansion agent after the treatment has been completed in order to avoid affecting aroma and other properties of the smoke due to extraneous substances used or developed from the combustion of the treated tobacco.

The use of carbonated water has also not been found to be effective.

While the method employing ammonia and carbon dioxide gases is an improvement over the earlier described methods, it is not completely satisfactory under some circumstances, in that undesired deposition of salts can result during the process.

Carbon dioxide has been used in the food industry as a coolant and, more recently, has been suggested as an extractant for food flavors. It has also been described in German Offenlegungsschrift No. 2,142,205 (Anmeldetag; Aug. 23, 1971) for use, in either gaseous or liquid form, to extract aromatic materials from tobacco. However, there has been no suggestion, in connection with these uses, of the use of gaseous carbon dioxide for the expansion of these materials.

A process employing liquid carbon dioxide has been found to overcome many of the disadvantages of the above-mentioned prior art processes. The expansion of tobacco, using liquid carbon dioxide is described in Belgium Pat. No. 821,568, which corresponds to U.S. application Ser. No. 441,767 to de la Burde and Aument (two of the present co-inventors) and assigned to the same assignee as the present application and in Belgium Pat. No. 825,133 to Airco, Inc. This process may be described as a process for expanding tobacco comprising the steps of (1) contacting the tobacco with liquid carbon dioxide to impregnate the tobacco with the liquid carbon dioxide, (2) subjecting the liquid carbon dioxide-impregnated tobacco to conditions such that the liquid carbon dioxide is converted to solid carbon dioxide and (3) thereafter subjecting the solid carbon dioxide-containing tobacco to conditions whereby the solid carbon dioxide is vaporized to cause expansion of the tobacco.

In our earlier work with gaseous $CO_2$, at pressures of about 100 psia, we had found that only minute amounts of carbon dioxide gas could be incorporated in the tobacco and held there sufficiently long for the tobacco to be heated and expanded. Thus, we found no substantial improvement over the prior art and gaseous $CO_2$ was believed to be much less effective as an expanding agent than the liquid carbon dioxide employed in the expansion process of the above-mentioned United States application Ser. No. 441,767. We have now found that gaseous carbon dioxide can be introduced into tobacco in a manner whereby the gaseous carbon dioxide remains in the tobacco in an amount of one percent or more to form a product which can then be expanded. Unexpectedly superior results and advantages can be achieved by employing gaseous $CO_2$ in the manner set forth in the present specification.

SUMMARY OF THE INVENTION

A novel tobacco product comprises tobacco containing gaseous carbon dioxide in an amount of at least 1 part of gaseous carbon dioxide per 100 parts of tobacco. The product, when rapidly heated is converted to expanded tobacco. An improved process for the expansion of tobacco is also provided which employs carbon dioxide as the expansion agent. Tobacco, generally having a moisture content of from about 5 to about 35% by weight, is placed in a pressure vessel or similar confinable space. Carbon dioxide gas may be passed through to flush the vessel. Carbon dioxide pressure is then increased and brought to a value of from about 250 pounds per square inch gauge (psig) to about 1057 psig or even higher, and preferably to about 400 to 800 psig. The tobacco is maintained under such a pressure under conditions whereby the carbon dioxide is substantially gaseous for from about ¼ to about 30 minutes, to impregnate the tobacco with carbon dioxide. The pressure is then reduced in a period of from 1 to 800 seconds, preferably 10 to 120 seconds, preferably to atmospheric pressure, to produce a product comprising tobacco containing at least 1% by weight of gaseous carbon dioxide, based on the weight of tobacco. The resulting gaseous carbon dioxide-containing tobacco may then be heated in the same vessel but is preferably rapidly transferred, preferably within a few minutes, to a separate zone where it is subjected to conditions of temperature and pressure, as by rapid heating in a gas at 100° to 370° C. and at or near atmospheric pressure for a period of from about 1 second to about 10 minutes, to expand the tobacco.

In an improvement on the present invention, which improvement is the subject of U.S. application Ser. No. 891,290, filed of even date herewith, entitled "Improved Process for the Expansion of Tobacco" in the name of Francis V. Utsch, one of the present coinventors, the tobacco/$CO_2$ system is cooled during or after pressurization, as by circulation of a cooling agent through the jacket of the chamber, to a temperature close to the saturation temperature of carbon dioxide but not lower than −23° C. As an alternative to using a cooling jacket in the improved process, $CO_2$ gas can be caused to flow through the system by venting a portion of the $CO_2$ gas either during or following pressurization, preferably while maintaining an infeed of $CO_2$ gas such that there is not a loss in the system pressure due to the venting. With cooling, the resulting conditions are such that the carbon dioxide at the prevailing temperature and pressure remains substantially in the gaseous state, but further such that the carbon dioxide, upon rapid reduction of pressure upon the system, is converted partially to a condensed state within the tobacco. Such conditions may be defined as such that the enthalpy of the carbon dioxide is kept at a value which is less than about 140 BTU per $lb_m$. By this means, a significantly greater residue of carbon dioxide remains in the tobacco at the beginning of the expansion step, than is the case without the cooling before pressure release, wherein the carbon dioxide, at higher enthalpy, remains primarily in the gas phase throughout. A further method of reducing the enthalpy of the system thereby causing an increased retention of carbon dioxide involves admission of additional quantities of $CO_2$ gas during venting thereby causing additional sweeping of $CO_2$ gas to flow through the system.

In connection with the present invention, if desired, the retention of carbon dioxide in the tobacco can be increased by pre-cooling or pre-freezing the tobacco prior to the impregnation cycle to cause a reduction in the system enthalpy. A still further method of increasing the retention of carbon dioxide in the tobacco involves "pre-snowing" the tobacco with finely divided solid carbon dioxide (dry ice) prior to the impregnation cycle which accomplishes both a pre-cooling of the tobacco and serves as an additional source for providing carbon dioxide to the tobacco; applied in proper amounts of from about 5–50% by weight of the tobacco, at least a portion of the dry ice will be incorporated into the tobacco during the pressurization cycle and by varying the amount of dry ice applied, a method of increasing and controlling the amount of carbon dioxide retained by the tobacco becomes possible. When such methods are involved, the tobacco/$CO_2$ system may be maintained for ¼ to 30 minutes during the impregnation step, where the pressure is at least 250 psig, to impregnate the tobacco with carbon dioxide. The pressure is then reduced, in a period of 1 to 800 seconds, preferably 10 to 120 seconds and preferably but not necessarily to atmospheric pressure. The tobacco is then rapidly transferred to a zone where it is subjected to conditions of temperature and pressure, as by rapid heating in a gas at 100° to 370° C. and at or near atmospheric pressure for one second to 10 minutes, to expand the tobacco.

DETAILED DESCRIPTION OF THE INVENTION

Figure 1:
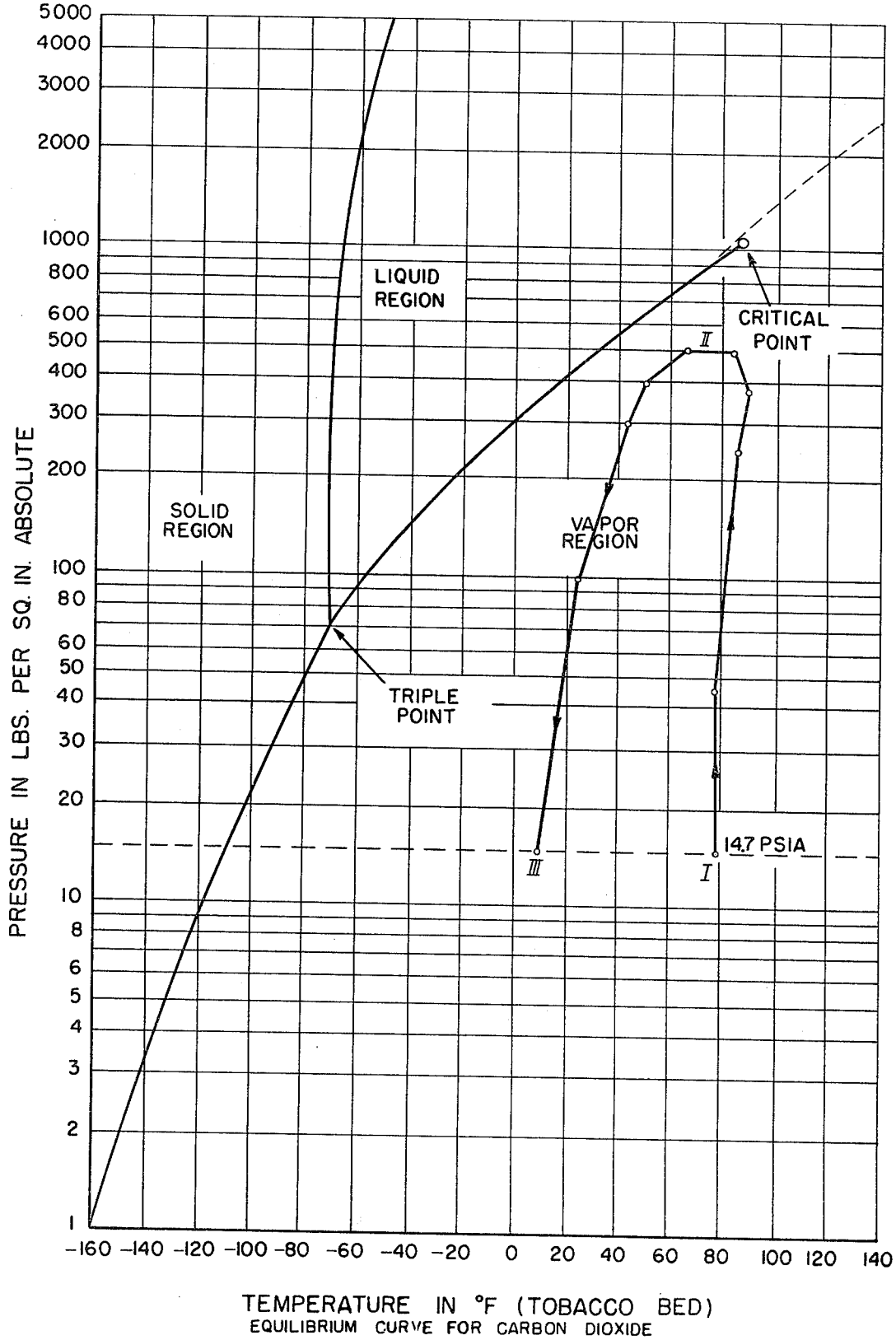

This invention relates broadly to an improved process for expanding tobacco employing a readily-available, relatively inexpensive, non-combustible, inoffensive, and non-toxic expansion agent and more particularly, to the production of an expanded tobacco product of substantially reduced density and increased filling power. The improved process employs carbon dioxide as the expansion agent. In general, the process comprises placing tobacco, preferably having a moisture content of from about 5 to about 35%, by weight, in a vessel or similar confinable space; the vessel or space may then be flushed with gaseous $CO_2$ to remove most of the associated air, although this is not essential to the invention. The vessel is closed except for an inlet port, and carbon dioxide gas is introduced and the pressure increased, by continued gas introduction or heating or both, under conditions whereby the $CO_2$ in the vessel remains primarily in the gas state to a final pressure of at least 250 psig, preferably 400 to 800 psig. The required temperature to maintain the $CO_2$ in a substantially gaseous state at a given pressure may be determined readily by one familiar with the use of phase diagrams or critical tables. While pressures as high as 900 psig might be economically employed, and a pressure of about 1057 would be acceptable, there is no known upper limit to the useful impregnation pressure range, other than that imposed by the capabilities of the equipment available. However, operation below the critical temperature is preferred for ease of control. The tobacco may be maintained under these impregnating conditions from about ¼ to 30 minutes, the longer times being in general applicable to lower pressure operation. Reference to the pressure-enthalpy diagram for $CO_2$ as set forth in FIG. 1 of the drawing will be of help in selecting desired conditions. After the impregnation step, the gas pressure is reduced by venting. The final pressure may be atmospheric or some pressure near that to be employed in the expansion step, but preferably the former. The time of pressure reduction is from 1 to about 800 seconds. The gaseous carbon dioxide-containing tobacco is then transferred to a zone where it is subjected to conditions whereby the carbon dioxide is removed to expand the tobacco. The transfer of the carbon dioxide-containing tobacco to the heating or expansion zone should preferably be effected within as short a time as possible, preferably within above five minutes, and most preferably within about two minutes. As an alternative to rapid transfer, if desired, the carbon dioxide-containing tobacco may be stored in an insulated bulker or chilled or otherwise maintained in a relatively cool condition. The heating or expansion step preferably involves exposing the carbon dioxide-containing tobacco to rapid heating at a temperature of about 100° to 370° C. for a period of time of from about 1 second to 10 minutes and substantially atmospheric pressure.

To carry out the process of the invention, one may treat either whole cured tobacco leaf, tobacco in cut or chopped form, or selected parts of tobacco, such as tobacco stems or may be reconstituted tobacco. In comminuted form, the tobacco to be treated may have a particle size of from about 10 to about 100 mesh, but is preferably not smaller than about 30 mesh.

The tobacco may contain the natural moisture content of tobacco and may contain from about 5 to about 35% by weight moisture. It is preferred, however, for best results that the tobacco have at least about 8% moisture (by weight) and no more than about 22% (by weight) moisture. As used herein, % moisture may be considered equivalent to oven volatiles (OV) since not more than about 0.9% of the tobacco weight is volatiles other than water. The procedure for determining oven volatiles is set forth later in this specification.

The tobacco will generally be placed in a pressure vessel which will be more fully described hereinafter. For example, it may be placed in a wire cage or on a platform positioned within the vessel.

The tobacco-containing pressure vessel may be then purged with carbon dioxide gas. The benefits of purging are the removal of gases that might interfere with a carbon dioxide recovery process and/or that might interfere with full penetration of the gaseous carbon dioxide. As an alternative to purging with carbon dioxide gas, the vessel may be evacuated prior to introduction of the carbon dioxide gas.

Either with or without a preliminary purging or evacuation of the vessel, carbon dioxide gas is fed to the vessel under conditions whereby the carbon dioxide gas pressure in the vessel is increased under conditions whereby the tobacco in the vessel is preferably at a temperature of from about −10° to about 60° C., and the pressure in the vessel is above about 250 psig, preferably about 400 to 800 psig. The tobacco is maintained under conditions whereby the carbon dioxide is at a pressure above about 250 psig and is under conditions above and to the right of the saturated vapor line of FIG. 1 of the drawing from a period of from about 15 seconds to about 30 minutes. The prssure is then reduced over a period of from about 1 to about 800 seconds, preferably 10 to 120 seconds, such that the temperature at no point drops below the saturation temperature for carbon dioxide at the simultaneous pressure, and the tobacco is brought to a temperature below about 10° C., and atmospheric pressure or the pressure at which the expansion step is to be carried out.

In the improvement of this invention, the tobacco/$CO_2$ system during the impregnation step is cooled, as for example, by circulation of a refrigerant through the jacket of the vessel containing the system, to reduce the enthalpy of the carbon dioxide below about 140 BTU/$lb_m$, preferably while the pressure is maintained relatively constant by admission of additional carbon dioxide gas. The cooling is limited so that the carbon dioxide is not condensed to any significant degree. The system is maintained under these impregnating conditions from about ¼ to 30 minutes, the longer times being in general applicable to lower pressure operation. Reference to the aforementioned phase diagram or critical tables for carbon dioxide will be of help in selecting desired conditions. The pressure-temperature relationship is preferably maintained to keep the carbon dioxide gas at or near the saturation point. It is believed that when the conditions are close to or at saturation, the absorption/adsorption characteristics of gaseous $CO_2$ are greatly enhanced. This results in improved retention of gaseous $CO_2$. The final pressure, when the pressure is reduced, may be atmospheric or some pressure near that to be employed in the expansion step, but is preferably atmospheric. The time of pressure reduction may be from about 1 to about 800 seconds.

It has been found that after the impregnation step, under conditions where the cooling of the improved process is not employed, a product will be formed having at least one part of carbon dioxide gas per one hundred parts of tobacco. By this is meant that at least one part of carbon dioxide gas, per one hundred parts of tobacco, will be associated with the tobacco in some manner, chemically and/or physically, for example by being absorbed by the tobacco. The product may have as high as three parts or more of gaseous carbon dioxide, when the process is so conducted. This has been found to occur in the absence of added adsorbents or the like. Adsorbents, absorbents or the like may be present; however, it is preferred that they not be present since the process is effective without them and they might introduce undesired elements into the smoke or might not release the carbon dioxide in a totally effective manner. It has been found that after the impregnation step, the tobacco may contain even greater amounts of carbon dioxide, as high as 3 parts (per hundred of tobacco) or more.

The tobacco, after the impregnation step, may then be transported to a zone where it is subjected to conditions such that the carbon dioxide is removed and the tobacco is expanded, preferably by exposure to rapid heating at 100° to 370° C. for 1 second to 10 minutes and substantially atmospheric pressure.

Although it is specifically claimed in the application mentioned elsewhere in this specification as being filed of even date herewith in the name of Francis V. Utsch, one of the present coinventors, a description of the improvement on the presently claimed process will be described below, said improvement relating specifically to the impregnation step.

To carry out the improvement on the present process, one may treat either whole cured tobacco leaf, tobacco in cut or chopped form, or selected parts of tobacco, such as tobacco stems or may be reconstituted tobacco. In comminuted form, the tobacco to be treated may have a particle size of from about 10 to about 100 mesh, but is preferably not smaller than about 30 mesh.

The tobacco may contain the natural moisture content of tobacco and may contain from about 5 to about 35% by weight moisture. It is preferred, however, for best results that the tobacco have at least about 8% moisture (by weight) and no more than about 22% (by weight) moisture. As used herein, % moisture may be considered equivalent to oven volatiles (OV) since not more than about 0.9% of tobacco weight is volatiles other than water. Oven volatiles determination is a simple measurement of weight loss on exposure in a circulating air oven for 3 hours at 100° C.

The tobacco will generally be placed in a pressure vessel which will be more fully described hereinafter. For example, it may be placed in a wire cage or on a platform positioned within the vessel.

The tobacco-containing pressure vessel may be then purged with carbon dioxide gas. The benefits of purging are the removal of gases that might interfere with a carbon dioxide recovery process and/or that might interfere with full penetration of the gaseous carbon dioxide. As an alternative to purging with carbon dioxide gas, the vessel may be evacuated prior to introduction of the carbon dioxide gas.

The carbon dioxide which is employed in the process of this invention will generally be obtained from a storage vessel where it is maintained at a pressure of from about 215 to 305 psig and temperatures of from −29° to −16° C. The carbon dioxide may be introduced into the pressure vessel at 215 to 320 psig and −29° to −14° C., but is preferably brought, by suitable means, to a temperature above −23° C., and a pressure above 250 psig before being introduced into the pressure vessel.

Either with or without a preliminary purging or evacuation of the vessel, carbon dioxide gas is fed to the vessel under conditions whereby the carbon dioxide gas pressure in the vessel is increased under conditions whereby the tobacco in the vessel is at a temperature of from about −10° to about 60° C., and the pressure in the vessel is above about 250 psig, preferably about 400 to 800 psig. The tobacco/$CO_2$ system is cooled in such a way that the $CO_2$ enthalpy is brought below about 140 BTU/$lb_m$ but the gas is preferably not condensed to any significant degree, while the pressure is, preferably, held substantially constant by admission of additional gas, and the system is maintained at these conditions from about 15 seconds to about 30 minutes. The pressure is then reduced over a period of from about 1 to about 800 seconds, whereby the tobacco is brought to a temperature below 10° C., and atmospheric pressure or the pressure at which the expansion step is to be carried out.

The resulting carbon dioxide-treated tobacco may then be rapidly transported, as described earlier in this specification, to a zone where it is exposed to expansion conditions, by subjecting it to heat or the equivalent in order to remove the carbon dioxide from the tobacco. This may comprise the use of hot surfaces, or a stream of hot air, a mixture of gases and steam, or exposure to other energy sources, such as microwave energy or infrared radiation. It has been found that the use of a gas composition comprising at least 50% (by weight) of steam, and preferably above 80% (by weight) of steam, provides particularly satisfactory results. A convenient means of expanding the carbon dioxide-containing tobacco is to place it or to entrain it in a stream of heated gas, such as superheated steam or to place it in a turbulent air stream maintained, for example, at a temperature of from about 150° to about 260° C. (as low as 100° C. and as high as 370° C.) for a period of about 1 second to 10 minutes. The impregnated tobacco may also be heated by being placed on a moving belt and exposed to infrared heating, by exposure in a cyclone dryer, by contact in a tower with superheated steam or a mixture of steam and air or the like. Any such contacting steps should not raise the temperature of the atmosphere with which the tobacco is in contact to above about 370° C. and should preferably be from at about 100° to about 300° C., most preferably 150° to 260° C. when conducted at atmospheric pressure.

As is well known in the processing of any organic matter, overheating can cause damage, first to color, such as undue darkening, and finally, to the extent of charring. The necessary and sufficient temperature and exposure time for expansion without such damage is a function of these two variables as well as the state of subdivision of the tobacco. Thus, to avoid undesirable damage in the heating step, the impregnated tobacco should not be exposed to the higher temperature levels, e.g., 370° C., longer than 1 to 2 seconds.

One method for causing the expansion of the tobacco cells is to use the radiation methods described in either U.S. Pat. Nos. 3,409,022 or 3,409,027. In this operation, the tobacco never attains a temperature above about 140° C., being cooled by the rapid evolution of gases. The presence of steam during heating assists in obtaining optimum results.

Another system, usually preferred, is to use a dispersion dryer, for example, one that is supplied either with steam alone or in combination with air. An example of such a dryer is a Proctor & Schwartz PB dispersion dryer, usually called hereafter a tower. The temperature in the dryer may range from about 120° to 370° C. with contact time in the dryer of about 1 to 10 seconds. In general, a 1 to 6 second contact time is utilized when the hot gas temperature is 260° to 315° C. or somewhat higher. As stated before, other known types of heating means may be used as long as they are capable of causing the impregnated tobacco to expand without excessive darkening. The presence of a steam atmosphere of 20% or more of the total hot gas composition aids in obtaining the best expansion; a high proportion (e.g., over 80% volume) of steam is preferred.

Figure 2:
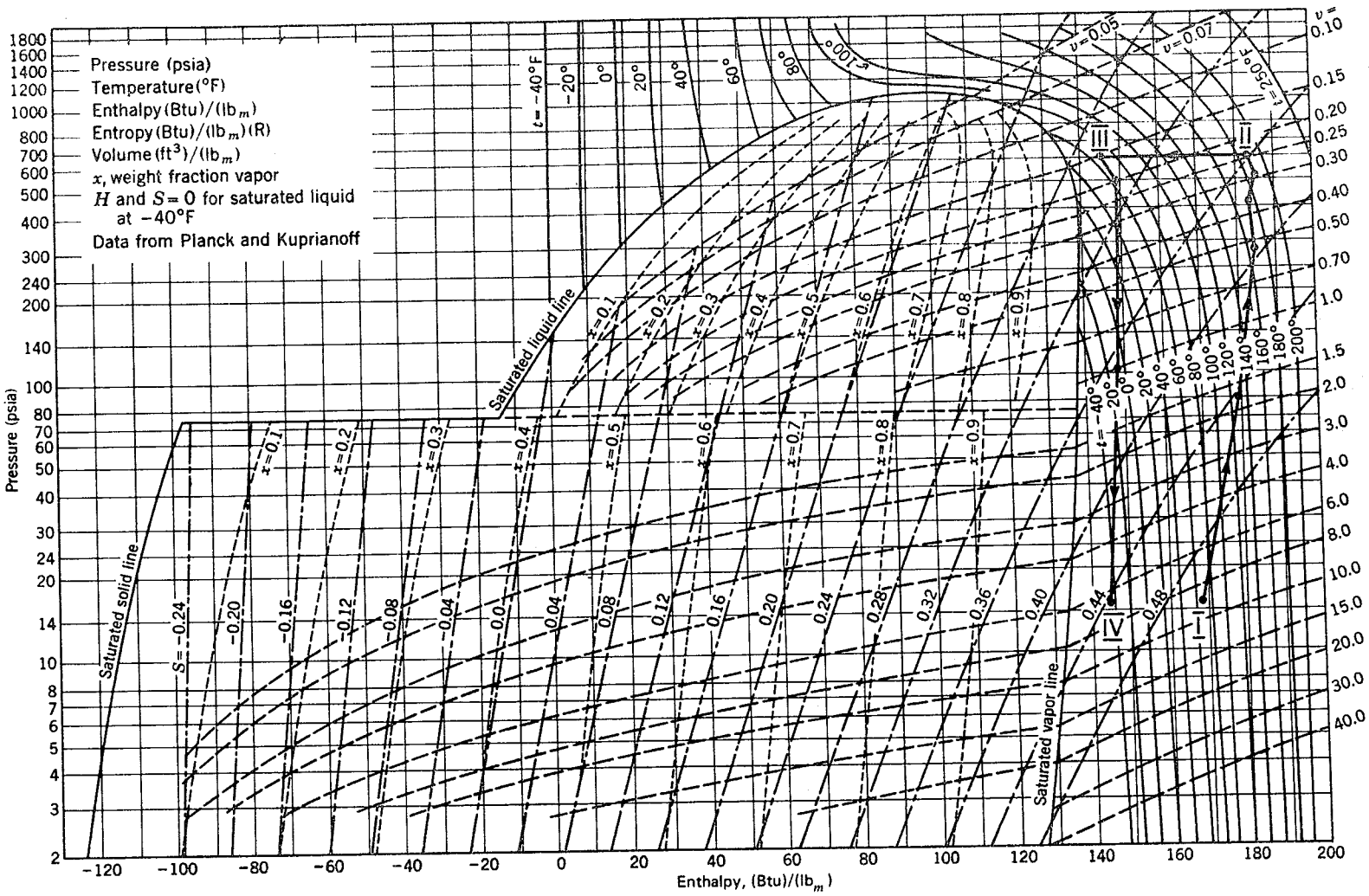

The present invention may be further understood by referring to the drawings. In the drawings:

FIG. 1 is a standard phase diagram plotting pressure of $CO_2$ (in p.s.i.a.) vs temperature (in 20 F.) of the tobacco bed for the carbon dioxide-tobacco system, with line I-II-III drawn thereon as an illustration of the system involved here. FIG. 2 is a standard pressure enthalpy diagram, with line I-IV drawn thereon to further illustrate the present invention.

As a general illustration of the practice of this invention, reference may be made to FIG. 1. The conditions may, for example, be such as are represented by line I-II-III on FIG. 1. For example, the tobacco, at about 12% OV in the form of cut bright filler, is placed in a pressure vessel capable of handling the desired pressure, for example, capable of handling a pressure of 1057 psig. The vessel may be similar to the impregnation vessel described in U.S. application Ser. No. 441,767, but, in distinction to that apparatus, need have no means for the handling of liquid $CO_2$. The vessel may be flushed with gaseous $CO_2$ or may be evacuated and is pressured with gaseous $CO_2$ to bring the contents to a condition (at II) where the pressure is greater than 250 psig and the temperature is not less than −23° C. The pressure is then released (to III). The conditions of the entire sequence (as shown by line I-II-III) are such that the carbon dioxide is maintained below and to the right of the saturated vapor line on FIG. 1.

In one form of the invention, as may be seen from FIG. 2, the enthalpy of the $CO_2$ is greater than about 140 BTU/$lb_m$ and the $CO_2$ is present in gaseous form. The vessel may be maintained at these conditions for $\frac{1}{4}$ to 30 minutes, as illustrated by line I-III. The pressure may then be reduced rapidly, preferably within 10 to 120 seconds, preferably to atmospheric pressure, as illustrated by line III-IV in FIG. 2.

The impregnated tobacco then is transferred (preferably, but not necessarily, directly) to a rapid heating zone or vessel such as the heating vessel described in U.S. application Ser. No. 441,767 mentioned above or as described earlier in this specification, for example, an expansion tower, microwave chamber, or the like.

The temperature at which the impregnated tobacco is maintained prior to the expansion or rapid heating step will largely govern how long the $CO_2$ remains in the tobacco in sufficient quantity to cause the desired expansion. If there is little insulation or means to keep the temperature down, the transfer should be rapid, preferably less than a few minutes. An insulated "bulking" container is preferred to accomplish the transfer. Supplementary cooling may also be provided as, for example, by appling crushed or powdered dry ice or by spraying liquid nitrogen on the impregnated tobacco.

The rapid heating causes expansion of the tobacco at a temperature where the tobacco is pliable and elastic and the tobacco can be expanded without fracture to an approximation of its green leaf state. A significant and useful degree of expansion is realized.

The following examples are illustrative:

EXAMPLE 1

A 1-pound sample of commercial cased bright tobacco filler at 12.5% OV was placed in an autoclave-type pressure vessel and was pressurized to 800 psig with $CO_2$ gas obtained from a $CO_2$ supply tank which was maintained at a $CO_2$ pressure at least slightly above the desired impregnation pressure. The impregnator system temperature was maintained above 30° during the pressure cycle by supplying extra heat to the system, when necessary, to prevent any formation of liquid or solid $CO_2$ during the entire processing cycle. After a 15-minute contact time, the pressure and temperature conditions of the $CO_2$ gas in the impregnator were found to correspond to an enthalpy value of about 142 BTU/lb of $CO_2$ gas. The pressure was released by venting in about 30 seconds after which the tobacco temperature was found to be 2.2° C. The impregnated sample has a weight gain of 2.0% which is attributable to the gaseous $CO_2$ contained therein. The impregnated material was then, without about 5 minutes time, exposed to heating in a 3-inch diameter tobacco expansion tower by contact with superheated steam at 288° C. and a velocity of 140 ft/sec for about 4 seconds. The product exiting the expansion tower had an OV of 2.1%. The product was equilibrated at standard conditions of 23.9° C. and 60% RH for about 18 hours. The filling power of the equilibrated product was measured by the standardized cylinder volume (CV) test described later in this specification as 74 cc/10 g at 11.2% OV. This gave a corrected CV (CCV) value at 11% OV of 76 cc/10 g. An unexpanded control was found to have a cylinder volume of 36 cc/10 g. The sample after processing, therefore, had a 111% increase in filling power as measured by the CV method.

EXAMPLE 2

A series of bright tobacco samples were treated as in Example 1 under conditions where gaseous $CO_2$ and substantially no liquid or solid $CO_2$ would be formed. The tobacco feed OV was varied from 9% to 14.6%. The conditions of each test and the test results are shown in Table I. Where no value is shown in the Table for a variable, the value is as in Example 1.

TABLE I

| Test # | Filler Expansion with Gaseous $CO_2$ 1 | 2 | 3 |
|---|---|---|---|
| Tobacco Feed OV | 9.0% | 10.3% | 14.6% |
| Impregnation Pressure, psig | 800 | 800 | 800 |
| $CO_2$ Temperature Prior to Vent, °C. | 31.7 | 31.7 | 32.2 |
| $CO_2$ Enthalpy prior to Vent, BTU/lb. | 143 | 143 | 143 |
| Tobacco Temp. after Venting, °C. | −20.0 | −22.8 | +2.8 |
| % $CO_2$ Retention on Tobacco | 2.9 | 2.4 | 1.5 |
| Product OV after Expansion | 1.7% | 1.8% | 3.2% |
| Reordered Product CV | 62 | 94 | 74 |
| Reordered Product OV | 11.6 | 10.3 | 11.3 |
| Corrected CV at 11% OV | 66 | 88 | 76 |
| % Increase in Filling Power | 83 | 144 | 111 |

EXAMPLE 3

A series of bright tobacco samples were treated as in Example 1 under conditions where gaseous $CO_2$ and substantially no liquid or solid $CO_2$ would be formed. The hold time was varied. The conditions and test results are shown in Table II. Where no valve is shown in the Table for a variable, the value is as in Example 1.

TABLE II

| Test # | Filler Expansion with Gaseous $CO_2$ 3 | 4 | 5 |
|---|---|---|---|
| Tobacco Feed OV | 14.2% | 14.4% | 15.3% |
| Impregnation Pressure, psig | 800 | 800 | 800 |
| Hold Time, Minutes | 1 | 2 | 20 |
| $CO_2$ Temperature prior to Vent, °C. | 58.9 | 30.0 | 35.6 |
| $CO_2$ Enthalpy prior to Vent, BTU/lb. | 160 | 142 | 144 |
| Tobacco Temp. after Venting, °C. | 8.3 | −5.6 | 4.4 |
| % $CO_2$ Retention on Tobacco | 2.0 | 2.6 | 1.5 |
| Product OV after Expansion | 2.2% | 2.0 | 3.8 |
| Reordered Product CV | 71.2 | 74.0 | 76.2 |
| Reordered Product OV | 11.1 | 11.6 | 11.6 |
| Corrected CV at 11% OV | 72 | 78 | 80 |
| % Increase in Filling Power | 100 | 117 | 122 |

EXAMPLE 4

A series of bright tobacco samples were treated as in Example 1 at conditions where no liquid or solid $CO_2$ would be expected to be formed. The impregnation pressure was varied. The test results are shown in Table III. Where no value is shown in the Table for a variable, the value is as in Example 1.

TABLE III

| Test # | Filler Expansion with Gaseous $CO_2$ 6 | 7 | 8 | 9 | 10 | 11 |
|---|---|---|---|---|---|---|
| Tobacco Feed OV | 14.5 | 13.6 | 10.3 | 16.1 | 13.2 | 13.3 |
| Impregnation Pressure, psig | 300 | 400 | 500 | 600 | 700 | 800 |
| Hold Time, Minutes | 15 | 15 | 15 | 25 | 15 | 15 |
| $CO_2$ Temperature prior to Vent, °C. | −11.7 | NA | 20.6 | 20.6 | 19.4 | 53.9 |
| $CO_2$ Enthalpy prior to Vent, BTU/lb | 143 | NA | 150 | 145 | 142 | 155 |
| Tobacco Temp. after Venting, °C. | −13.9 | NA | 3.3 | −5.6 | −16.7 | 20.6 |
| Product OV after Expansion | 2.2 | 1.9 | 2.1 | 2.1 | 3.4 | 2.7 |
| Reordered Product CV | 69 | 66 | 59 | 75 | 74 | 60 |
| Reordered Product OV | 10.7 | 11.5 | 11.7 | 11.4 | 11.5 | 11.6 |
| Corrected CV at 11% OV | 66 | 69 | 64 | 79 | 77 | 65 |
| % Increase in Filling Power | 83 | 92 | 78 | 119 | 114 | 81 |

EXAMPLE 5

A 1-pound sample of commercial cased bright tobacco filler at 11.1% OV was placed in an FS-3 pressure vessel and pressurized to 800 psig with $CO_2$ gas as in the procedure of Example 1. The impregnation system temperature was cooled by circulating a cooling solution through a jacket surrounding the impregnation vessel until the $CO_2$ gas in the impregnator was cooled to near its saturation temperature. After a 15-minute contact time, the pressure and temperature conditions of the $CO_2$ gas in the impregnator were found to correspond to an enthalpy value of about 130 BTU/lb of $CO_2$ gas. Although some $CO_2$ condensation probably occurred within the vessel, the $CO_2$ was present primarily as a gas. The pressure was released by venting in about 30 seconds after which the tobacco temperature was found to be −37.8° C. The impregnated sample had a weight gain of about 3.5% attributable to $CO_2$. This impregnated material was then heated as in Example 1. The product exiting the expansion tower had an OV of 1.9%. The equilibrated product had a CV of 90.6 at an OV of 10.8%. This corresponds to a CCV of 89 or an increase in filling power of 147% over the unexpanded control (36 cc/10 g).

EXAMPLE 6

A series of bright tobacco samples were treated as in Example 5 at conditions where the $CO_2$ gas would be cooled to near saturation prior to pressure release at three different pressures. The conditions and test results are shown in Table IV. Where no value is shown in the Table for a variable, the value is as in Example 1.

TABLE IV

| Test # | Filler Expansion with Gaseous $CO_2$ 12 | 13 | 14 |
|---|---|---|---|
| Tobacco Feed OV | 9.5% | 10.8 | 12.1 |
| Impregnation Pressure, psig | 800 | 600 | 500 |
| Hold Time, Minutes | 15 | 15 | 20 |
| $CO_2$ Temperature prior to Vent, °C. | 19.4 | 7.2 | 2.2 |
| $CO_2$ Enthalpy prior to Vent, BTU/lb. | 129 | 139 | 139 |
| Tobacco Temp. after Venting, °C. | −38.9 | −27.8 | −18.3 |
| % $CO_2$ Retention on Tobacco | 3.7 | 2.6 | 2.4 |
| Product OV after Expansion | 1.3% | 1.4 | 1.9 |
| Reordered Product CV | 89 | 88 | 71 |
| Reordered Product OV | 10.5 | 10.9 | 11.9 |
| Corrected CV at 11% OV | 85 | 87 | 78 |
| % Increase in Filling Power | 136 | 142 | 117 |

EXAMPLE 7

The procedure of Example 5 was repeated using cased burley tobacco. The equilibrated expanded product was found to have a CV of 92.4 at 10.1% OV or an increase of about 100% over the unexpanded control.

EXAMPLE 8

The procedure of Example 5 was repeated using a tobacco blend as normally used in cigarette manufacture. The product was found to have a CV of 78.1 at 11.1% OV or an increase of about 105% over the unexpected control.

EXAMPLE 9

A 1-pound sample of cased bright tobacco was processed as in Example 1 and found to have a CCV of 81. This product was blended at 25% with conventional tobacco blend. Cigarettes were smoked and found to have a desirable taste and aroma; firmness of the tobacco rod was acceptable.

EXAMPLE 10

A 13-pound sample of cased bright tobacco was processed as in Example 5. The product was found to have a CCV of 78.

EXAMPLE 11

A 5-pound sample of cased bright tobacco was impregnated as in Example 5 but was then subjected to heating in a static bed using 149° C. steam for a 5-minute exposure. The equilibrated product was found to have a CV of 85.

EXAMPLE 12

A series of runs was conducted following the process of Example 5 and the runs were found to give cylinder volume results of 80, 80, 80, 79, 84, 78, 79, 78 and 79, respectively. This gives an average CV of 80 for the 9 trials or an increase in filling power of 121% over the untreated control.

EXAMPLE 13

A series of 3 runs was conducted according to the process of Example 5, except that the feed tobacco was pre-chilled to a temperature just below −20° C. before the tobacco was contacted with the pressurized $CO_2$ gas. The reordered product CV results under these circumstances were found to be 92, 92 and 87, respectively. This gave an average increase in filling power of 151% over the untreated control.

EXAMPLE 14

Two series of runs were conducted in a manner similar to Example 1. However, conditions were as indicated in Table V with a ten-minute hold period and the tower conditions were: 3-inch tower at 600° F., with 100% steam. Series #2 was run under similar conditions to Series 190 1.

The results of both series of these runs are given in Table V together with the results for an unexpanded control sample and for a control sample which was expanded, without any $CO_2$ treatment:

TABLE V

| | Series #1 | | | Series #2 | | |
|---|---|---|---|---|---|---|
| Press. (psig) | % OV | Reordered CV/OV | CCV | % OV | Reordered CV/OV | CCV |
| Control | 11.8 | 36.8/12.6 | — | — | — | — |
| Exp. control | — | — | — | 1.9 | 64.6/10.9 | — |
| 250 | 2.5 | 72.8/10.8 | 71.2 | 1.5 | 73.8/10.8 | 72.3 |
| 300 | 2.8 | 76.3/10.8 | 74.9 | 1.2 | 81.4/10.7 | 78.9 |
| 325 | 2.6 | 77.2/10.8 | 75.9 | 1.2 | 79.6/10.7 | 77.5 |
| 350 | 2.3 | 78.4/11.0 | 78.4 | 1.2 | 77.3/11.2 | 78.5 |
| 375 | 2.4 | 80.6/11.1 | 81.0 | 1.4 | 78.7/11.1 | 79.6 |

TABLE V-continued

| | Series #1 | | | Series #2 | | |
|---|---|---|---|---|---|---|
| Press. (psig) | % OV | Reordered CV/OV | CCV | % OV | Reordered CV/OV | CCV |
| 400 | 2.6 | 78.5/11.2 | 79.9 | 1.4 | 82.0/11.1 | 85.6 |
| 800 | 2.8 | 92.0/11.2 | 93.3 | 1.5 | 97.6/11.1 | 98.0 |

It will be seen that pressures of 250 psig through 800 psig provided excellent expansion, compared with the controls.

The following experiments were also conducted:

EXPERIMENT 1

The impregnation procedure of Example 11 was repeated but the impregnated material was simply allowed to warm to room temperature and was not subjected to tower expansion. The resulting product showed no gain, and perhaps a slight loss, in CV compared to the untreated control.

EXPERIMENT 2

A comparison run of gaseous vs. liquid $CO_2$ impregnation was conducted in the following manner.

1. Liquid $CO_2$—Three pounds of cased commercial bright tobacco filler (OV of 12.7%) was impregnated with liquid $CO_2$ at 800 psig, cooled to 19.6° C., and held for 15 minutes. Thereafter the excess liquid was drained and the pressure was released. A 23% gain in weight was attributed to $CO_2$ pickup. The material was somewhat clumped together because of the large amount of retained $CO_2$.

2. Gaseous $CO_2$—Three pounds of cased commercial bright tobacco filler (OV of 13.3%) was pressurized with gaseous $CO_2$ at 800 psig and 19.6° C. for 15 minutes. Thereafter, the pressure was released. A 3% gain in weight was attributed to $CO_2$ pickup. the material was free-flowing and easy to handle.

Both samples were processed in a 4-inch diameter tobacco expansion tower and the samples were equilibrated and measured for cylinder volume. The samples which utilized the liquid impregnation was found to have a CCV of 79 and the comparable sample impregnated with $CO_2$ gas was found to have a CCV of 82.

EXPERIMENT 3

A series of trials was conducted over an impregnation pressure range of 20, 40, 60, 80, 100, 200, 300, 400, 600 and 800 psig, employing 10-minute contact time, following the pattern of Example 1, with expansion in the tower with a steam temperature of 316° C. These samples were run, together with an unexpanded control and with a control which was not contacted with $CO_2$ with the conditions and the results set forth in Table VI:

TABLE VI

| | | Reordered | | |
|---|---|---|---|---|
| Pressure (psig) | OV% | CV | OV | CCV |
| Control | 13.6 | 30.8 | 13.3 | 33.2 |
| Exp. control | 2.9 | 49.3 | 12.2 | 50.1 |
| 20 | 2.9 | 55.7 11.8 | 57.2 | |
| 40 | 2.4 | 54.3 | 11.9 | 56.3 |
| 60 | 2.0 | 57.7 | 11.6 | 58.2 |
| 80 | 2.5 | 57.7 | 11.7 | 58.7 |
| 100 | 2.6 | 55.7 | 11.7 | 56.7 |
| 200 | 2.3 | 56.4 | 11.7 | 57.4 |
| 300 | 2.7 | 55.0 | 11.8 | 56.5 |
| 400 | 1.9 | 65.9 | 11.5 | 68.9 |
| 600 | 1.8 | 75.9 | 11.6 | 80.7 |

TABLE VI-continued

| Pressure (psig) | OV% | Reordered CV | Reordered OV | CCV |
|---|---|---|---|---|
| 800 | 1.8 | 84.4 | 11.5 | 88.4 |

Table VI illustrates that some expansion may be obtained at lower pressures, but pressures of about 400 psig may be necessary to achieve product objectives. It will be seen, however, from Example 14, that a pressure of 250 psig can be effective to produce a satisfactory degree of expansion.

The terms "cylinder volume" and "corrected cylinder volume" are units for measuring the degree of expansion of tobacco. The term "oven-volatiles content" or "oven volatiles" is a unit for measuring moisture content (or percentage of moisture) in tobacco. As used throughout this application, the values employed, in connection with these terms, are determined as follows:

CYLINDER VOLUME (CV)

Tobacco filler weighing 10.000 g is placed in a 3.358-cm diameter cylinder and compressed by a 1875-g piston 3.335-cm in diameter for 5 minutes. The resulting volume of filler is reported as cylinder volume. This test is carried out at standard environmental conditions of 23.9° C. and 60% RH; conventionally unless otherwise stated, the sample is preconditioned in this environment for 18 hours.

CORRECTED CYLINDER VOLUME (CCV)

The CV value may be adjusted to some specified oven-volatile content in order to facilitate comparisons.

$CCV = CV + F\ (OV - OV_s)$ where $OV_s$ is the specified OV and F is a correctiodn factor (volume per %) predetermined for the particular type of tobacco filler being dealt with.

OVEN-VOLATILES CONTENT (OV)

The sample of tobacco filler is weighed before and after exposure for 3 hours in a circulating air oven controlled at 100° C. The weight loss as percentage of initial weight is oven-volatiles content.

For bright tobacco employed in the present application, the value of F in the calculation of CCV is 7.6 on average for gaseous $CO_2$ expanded tobacco.

Unless otherwise indicated, all percentages used herein are by weight.

What is claimed is:

1. A process for expanding tobacco to achieve at least about 50 percent increase in cylinder volume, comprising the steps of (1) impregnating tobacco with gaseous carbon dioxide under a pressure of at least about 250 psig and at sufficient temperature that substantially all of the carbon dioxide is maintained in gaseous form to incorporate in the tobacco at least 1 part of carbon dioxide per 100 parts of tobacco, (2) decreasing the pressure on the carbon dioxide-impregnated tobacco and (3) heating the impregnated tobacco under conditions effective to liberate the carbon dioxide therein so as to cause expansion of the tobacco.

2. The process of claim 1 wherein the pressure is reduced to substantially atmospheric pressure in step (2).

3. The process of claim 2 wherein said temperature in step (1) is sufficient that substantially all of the carbon dioxide remains in gaseous form when the pressure is reduced to atmospheric pressure.

4. The process of claim 2 wherein said pressure in step (1) is 400 to 800 psig.

5. The process of claim 2 wherein step (3) includes heating the tobacco to a temperature in the range of about 100° to 370° C.

* * * * *

UNITED STATES PATENT AND TRADEMARK OFFICE

CERTIFICATE OF CORRECTION

PATENT NO. : 4,258,729
DATED : March 31, 1981
INVENTOR(S) : Roger Z. de la Burde et al It is certified that error appears in the above–identified patent and that said Letters Patent are hereby corrected as shown below:

Column 2, line 36 change "70/8282" to ...70/8292...

Column 9, line 38 change "20 F" to ...°F...

Column 10, line 18 change "appling" to ...applying...

Line 34 - after "30°" insert ...C...

Line 44 change "has" to ...had...

Line 46 change "without" to ...within...

Column 13, lines 6 and 7 change "unexpected" to ...unexpanded...

Column 13, line 53 change "190" to ...#...

Column 14, Table VI, approximately line 61 move values "55.7", "11.8" and "57.2" to right under proper columns.

Column 15, line 39 change "correctiodn" to ...correction...

Signed and Sealed this

Tenth Day of November 1981

[SEAL]

*Attest:*

GERALD J. MOSSINGHOFF

*Attesting Officer*

*Commissioner of Patents and Trademarks*